US008519630B2

(12) United States Patent
Wang et al.

(10) Patent No.: US 8,519,630 B2
(45) Date of Patent: Aug. 27, 2013

(54) DRIVING CIRCUIT CAPABLE OF ENHANCING ENERGY CONVERSION EFFICIENCY AND DRIVING METHOD THEREOF

(75) Inventors: Jing-Chyi Wang, Hsin-Chu (TW); Chi-Ming Chen, Hsin-Chu (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 316 days.

(21) Appl. No.: 13/095,906

(22) Filed: Apr. 28, 2011

(65) Prior Publication Data

US 2012/0194073 A1 Aug. 2, 2012

(30) Foreign Application Priority Data

Jan. 28, 2011 (TW) ..... 100103334 A

(51) Int. Cl.
*H05B 37/02* (2006.01)

(52) U.S. Cl.
USPC ..... 315/185 R; 315/224; 315/293; 315/307

(58) Field of Classification Search
USPC ..... 315/185 R, 209 R, 224, 291, 293, 315/298, 307, 308
See application file for complete search history.

(56) References Cited

U.S. PATENT DOCUMENTS

| | | | | |
|---|---|---|---|---|
| 8,106,599 | B2 * | 1/2012 | Radermacher et al. | 315/291 |
| 8,120,263 | B2 * | 2/2012 | Lin et al. | 315/209 R |
| 2010/0295458 | A1 * | 11/2010 | Cheng et al. | 315/185 R |
| 2011/0006692 | A1 * | 1/2011 | Washiya et al. | 315/185 R |
| 2011/0234108 | A1 * | 9/2011 | Huang | 315/185 R |

* cited by examiner

*Primary Examiner* — Don Le
(74) *Attorney, Agent, or Firm* — Winston Hsu; Scott Margo

(57) ABSTRACT

A driving circuit includes a switch, a detecting unit, a current supply unit, and an energy storage unit. The current supply unit is used for providing a driving current for at least one series of light emitting diodes. The detecting unit is used for comparing a voltage of a first terminal of the detecting unit with a reference voltage to generate a switch control signal. When the switch is turned on according the switch control signal, a first voltage drives the series of light emitting diodes through the switch and the energy storage unit is charged according a charge current. When the switch is turned off according the switch control signal, the energy storage unit drives the series of light emitting diodes according to a discharge current.

10 Claims, 7 Drawing Sheets

DRIVING CIRCUIT CAPABLE OF ENHANCING ENERGY CONVERSION EFFICIENCY AND DRIVING METHOD THEREOF

BACKGROUND OF THE INVENTION

1. Field of the Invention

The present invention is related to a driving circuit, and particularly to a driving circuit that utilizes a switch, a detecting unit, and an energy storage unit to enhance energy conversion efficiency.

2. Description of the Prior Art

Please refer to FIG. 1A. FIG. 1A is a diagram illustrating a driving circuit 100 for driving light emitting diodes according to the prior art. As shown in FIG. 1A, the driving circuit 100 includes a rectifier 102 and a current supply unit 104. The rectifier 102 is used for receiving an alternating current voltage AC, and generating a first voltage V1 according to the alternating current voltage AC. The first voltage V1 is a direct current voltage and varies periodically with time. The first voltage V1 is used for driving a series of light emitting diodes 106, and the series of light emitting diodes 106 includes at least one light emitting diode. As shown in FIG. 1A, input power of the driving circuit 100 is a sum of power consumption PLED of the series of light emitting diodes 106 and power consumption PLOSS of the current supply unit 104. In addition, energy conversion efficiency ECE of the driving circuit 100 is generated by equation (1):

$$ECE=PLED/PLOSS \quad (1)$$

Please refer to FIG. 1B. FIG. 1B is a diagram illustrating a relationship between the power consumption PLED of the series of light emitting diodes 106 and the first voltage V1. As shown in FIG. 1A and FIG. 1B, after the series of light emitting diodes 106 is turned on, the power consumption PLOSS of the current supply unit 104 is increased with increase of the first voltage V1. However, the power consumption PLED of the series of light emitting diodes 106 is not increased with the increase of the first voltage V1 because the power consumption PLED is generated by equation (2):

$$PLED=VLED\times Id \quad (2)$$

As shown in equation (2), VLED is a voltage drop of the series of light emitting diodes 106, and Id is a driving current of the series of light emitting diodes 106. Therefore, the driving circuit 100 shown in FIG. 1A is not a good choice for driving light emitting diodes.

SUMMARY OF THE INVENTION

An embodiment provides a driving circuit capable of enhancing energy conversion efficiency. The driving circuit includes a switch, a detecting unit, a current supply unit, and an energy storage unit. The switch has a first terminal for receiving a first voltage, a second terminal, and a third terminal for being coupled to a first terminal of at least one series of light emitting diodes. The detecting unit has a first terminal for being coupled to a second terminal of the at least one series of light emitting diodes, a second terminal coupled to the second terminal of the switch for outputting a switch control signal, and a third terminal coupled to ground, where the detecting unit is used for generating the switch control signal according to a voltage of the second terminal of the at least one series of light emitting diodes. The current supply unit has a first terminal for being coupled to the second terminal of the at least one series of light emitting diodes, and a second terminal coupled to the ground, where the current supply unit is used for providing a driving current to the at least one series of light emitting diodes. The energy storage unit has a first terminal for being coupled to the first terminal of the at least one series of light emitting diodes, and a second terminal coupled to the ground, where the energy storage unit is used for being charged according to a charge current when the switch is turned on, and transmitting energy stored in the energy storage unit to the at least one series of light emitting diodes when the switch is turned off.

Another embodiment provides a driving method capable of enhancing energy conversion efficiency. The method includes a detecting unit comparing a voltage of a first terminal of the detecting unit with a reference voltage to generate a detection result; the detecting unit, a switch and an energy storage unit performing corresponding operation respectively according to the detection result.

The present invention provides a driving circuit capable of enhancing energy conversion efficiency and a driving method thereof utilize a detecting unit to compare a voltage of a second terminal of at least one series of light emitting diodes with a reference voltage for determining whether a switch is turned on or turned off. Therefore, the present invention can reduce power consumption of a current supply unit. That is to say, the power consumption of the current supply unit is not increased with increase of a first voltage. Thus, compared to the prior art, the present invention can enhance the energy conversion efficiency.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3A is a diagram illustrating corresponding operation of the driving circuit when the switch is turned on.

DETAILED DESCRIPTION

Figure 1A:
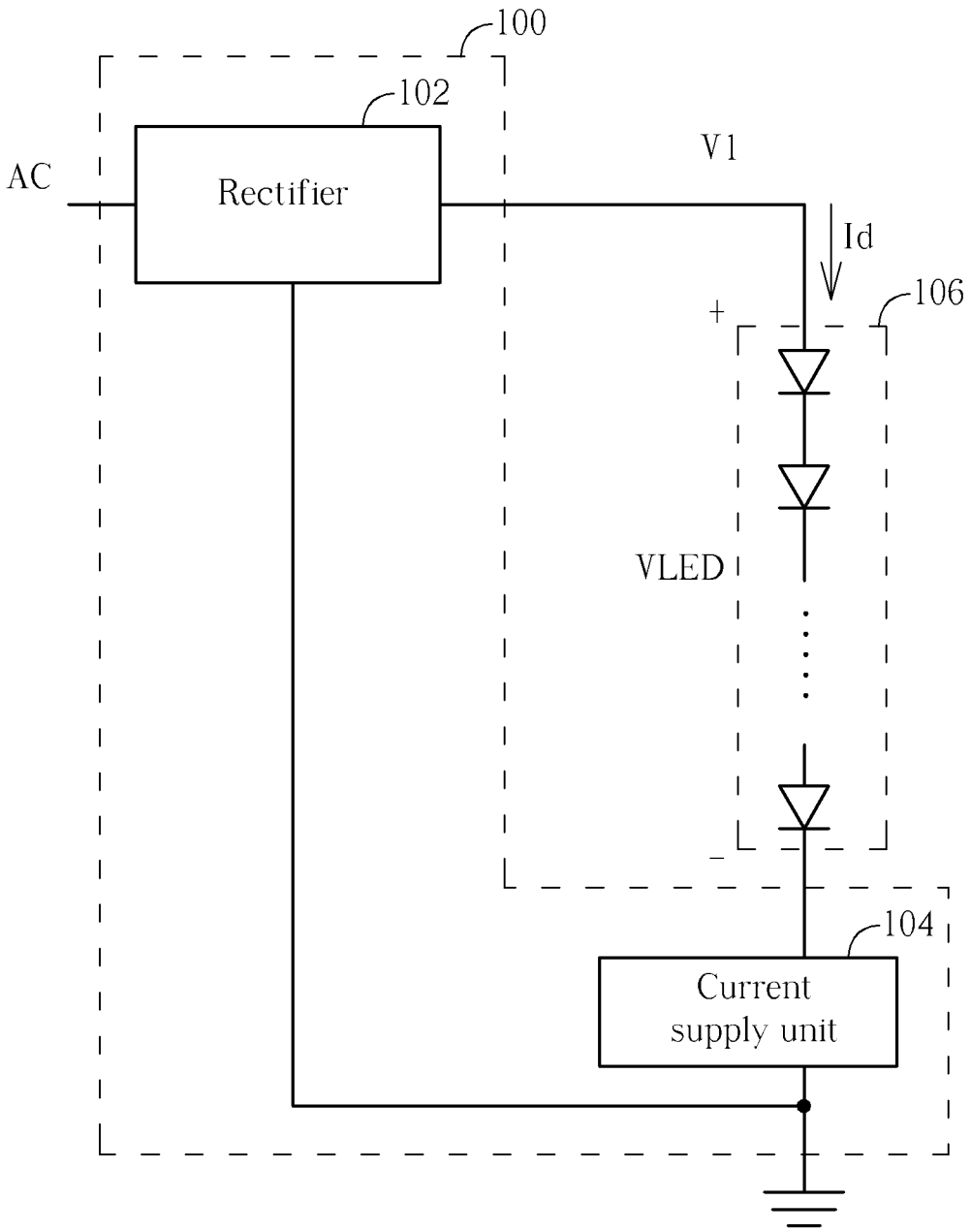
FIG. 1A PRIOR ART
FIG. 1A is a diagram illustrating a driving circuit for driving light emitting diodes according to the prior art.
Figure 1B:
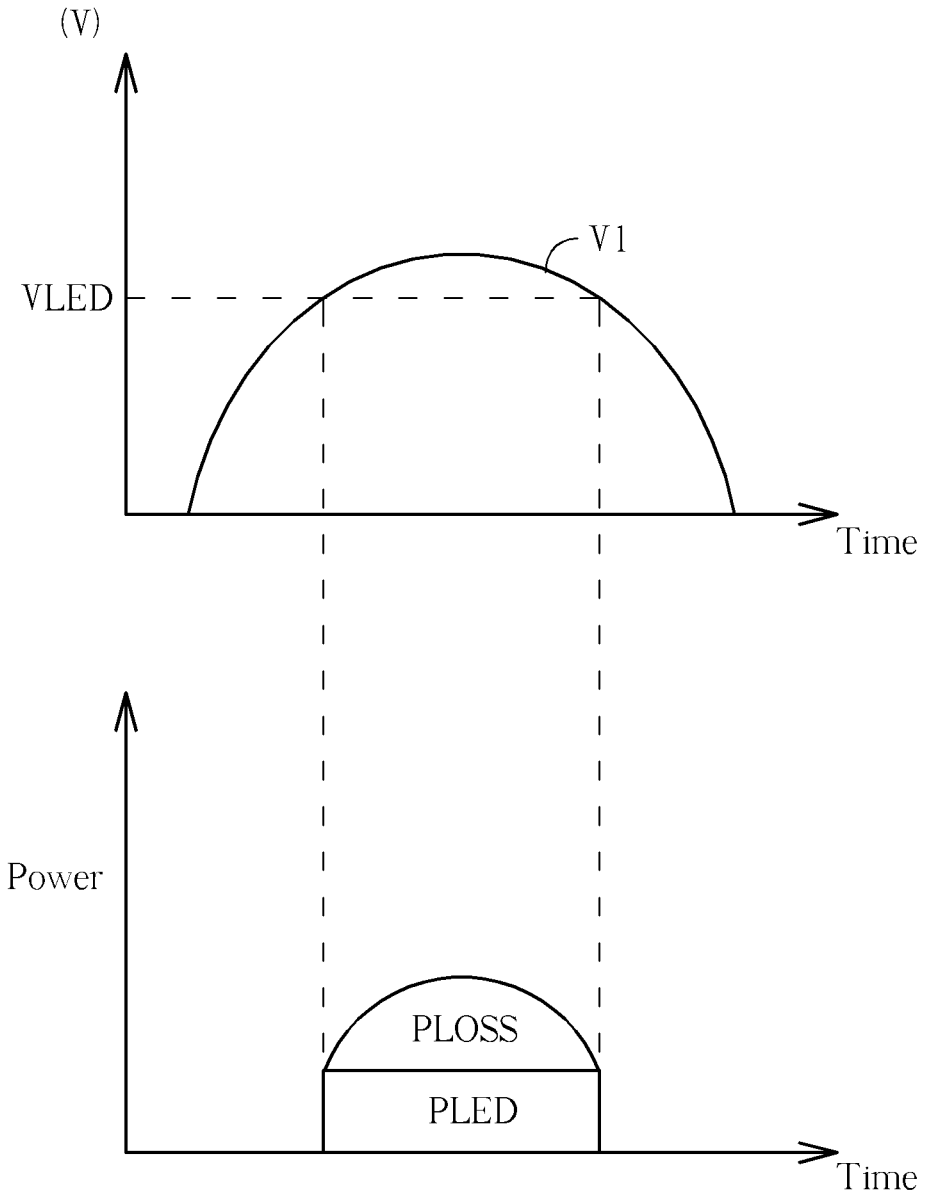
FIG. 1B PRIOR ART
FIG. 1B is a diagram illustrating a relationship between the power consumption PLED of the series of light emitting diodes 106 and the first voltage V1.
Figure 2:
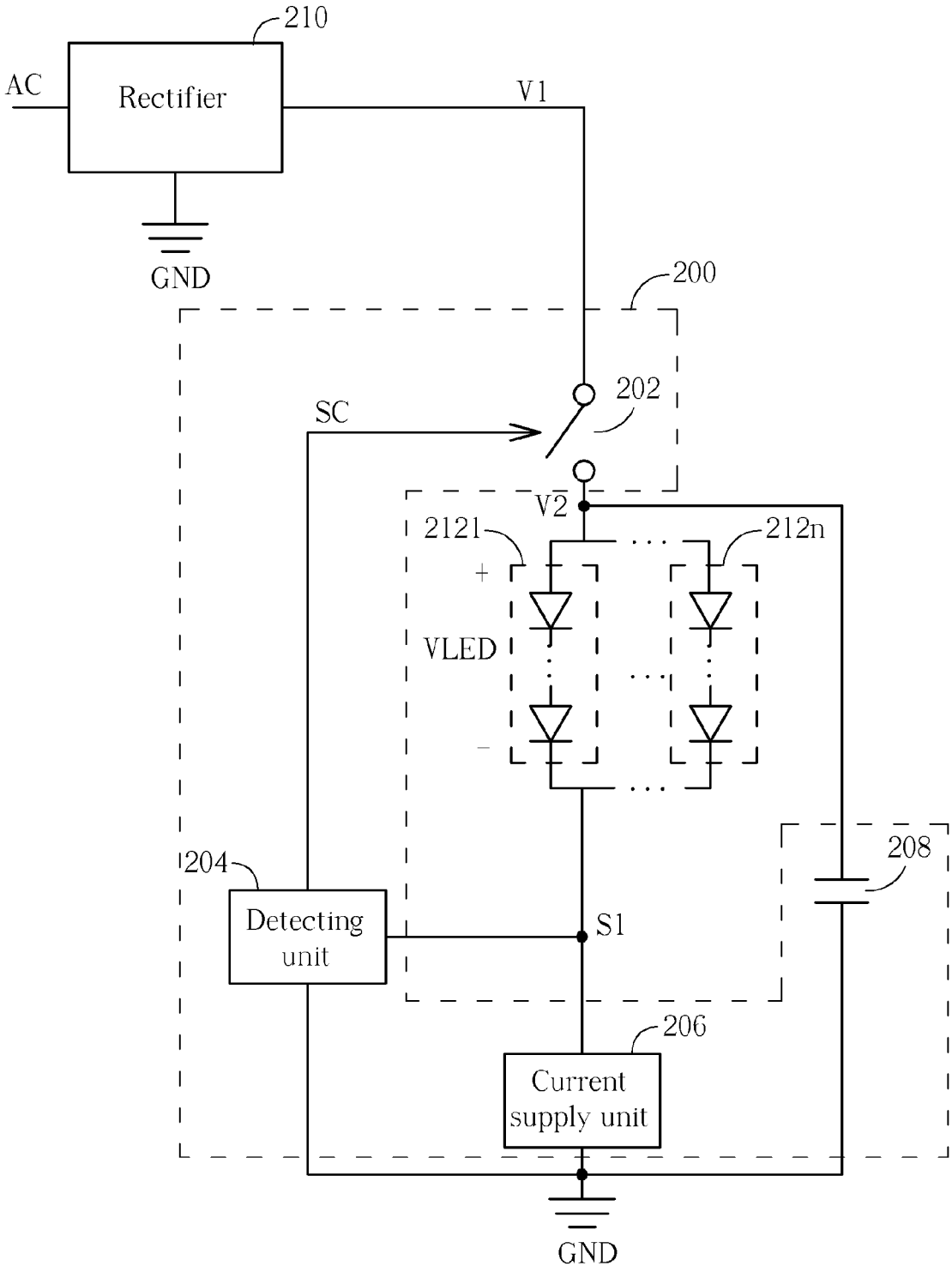
FIG. 2 is a diagram illustrating a driving circuit capable of enhancing energy conversion efficiency according to an embodiment.

Please refer to FIG. 2. FIG. 2 is a diagram illustrating a driving circuit 200 capable of enhancing energy conversion efficiency according to an embodiment. As shown in FIG. 2, the driving circuit 200 includes a switch 202, a detecting unit 204, a current supply unit 206, and an energy storage unit 208. The switch 202 is a P-type metal-oxide-semiconductor transistor, an N-type metal-oxide-semiconductor transistor, or a transmission gate. The energy storage unit 208 is a capacitor. The switch 202 has a first terminal for receiving a first voltage V1 generated by a rectifier 210, a second terminal, and a third terminal coupled to a first terminal of at least one series of light emitting diodes 2121-212*n*. Each series of light emitting diodes of the at least one series of light emitting diodes 2121-212*n* includes at least one light emitting diode, where n≧1, and n is a positive integer. When the switch 202 is turned on, the switch 202 generates a second voltage V2 according to the first voltage V1. In addition, each series of light emitting diodes of the at least one series of light emitting diodes 2121-212*n* has the same number of light emitting diodes. Further, the rectifier 210 is used for receiving an alternating current voltage AC, and generating the first voltage V1 according to the alternating current voltage AC, where the first voltage V1 is a direct current voltage and varies periodically with time. The detecting unit 204 has a first terminal for being coupled to a second terminal S1 of the at least one series of light emitting diodes 2121-212*n*, a second terminal coupled to second terminal of the switch 202 for outputting a switch control signal SC, and a third terminal coupled to ground GND. The detecting unit 204 is used for generating the switch control signal SC according to a voltage of the second terminal S1 of the at least one series of light emitting diodes 2121-212*n*. The current supply unit 206 has a first terminal for being coupled to the second terminal S1 of the at least one series of light emitting diodes 2121-212*n*, and a second terminal coupled to the ground GND. The current supply unit 206 is used for providing a driving current Id to the at least one series of light emitting diodes 2121-212*n*. The energy storage unit 208 has a first terminal for being coupled to the first terminal of the at least one series of light emitting diodes 2121-212*n*, and a second terminal coupled to the ground GND. The energy storage unit 208 is used for being charged according to a charge current Ic when the switch 202 is turned on, and transmitting energy stored in the energy storage unit 208 to the at least one series of light emitting diodes 2121-212*n* when the switch 202 is turned off. In addition, in another embodiment of FIG. 2, the driving circuit 200 includes the rectifier 210.

Figure 3A:
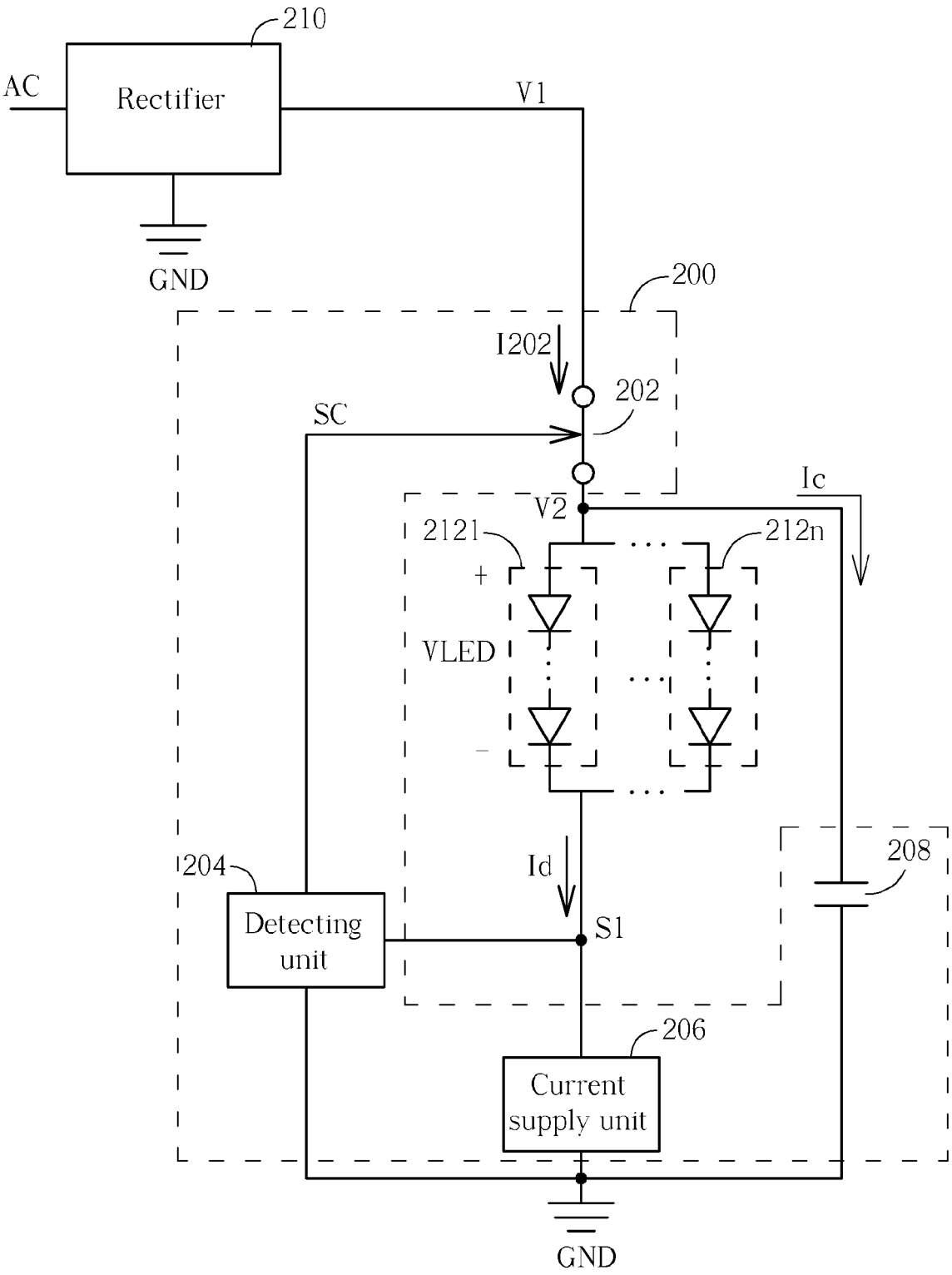
Figure 3B:
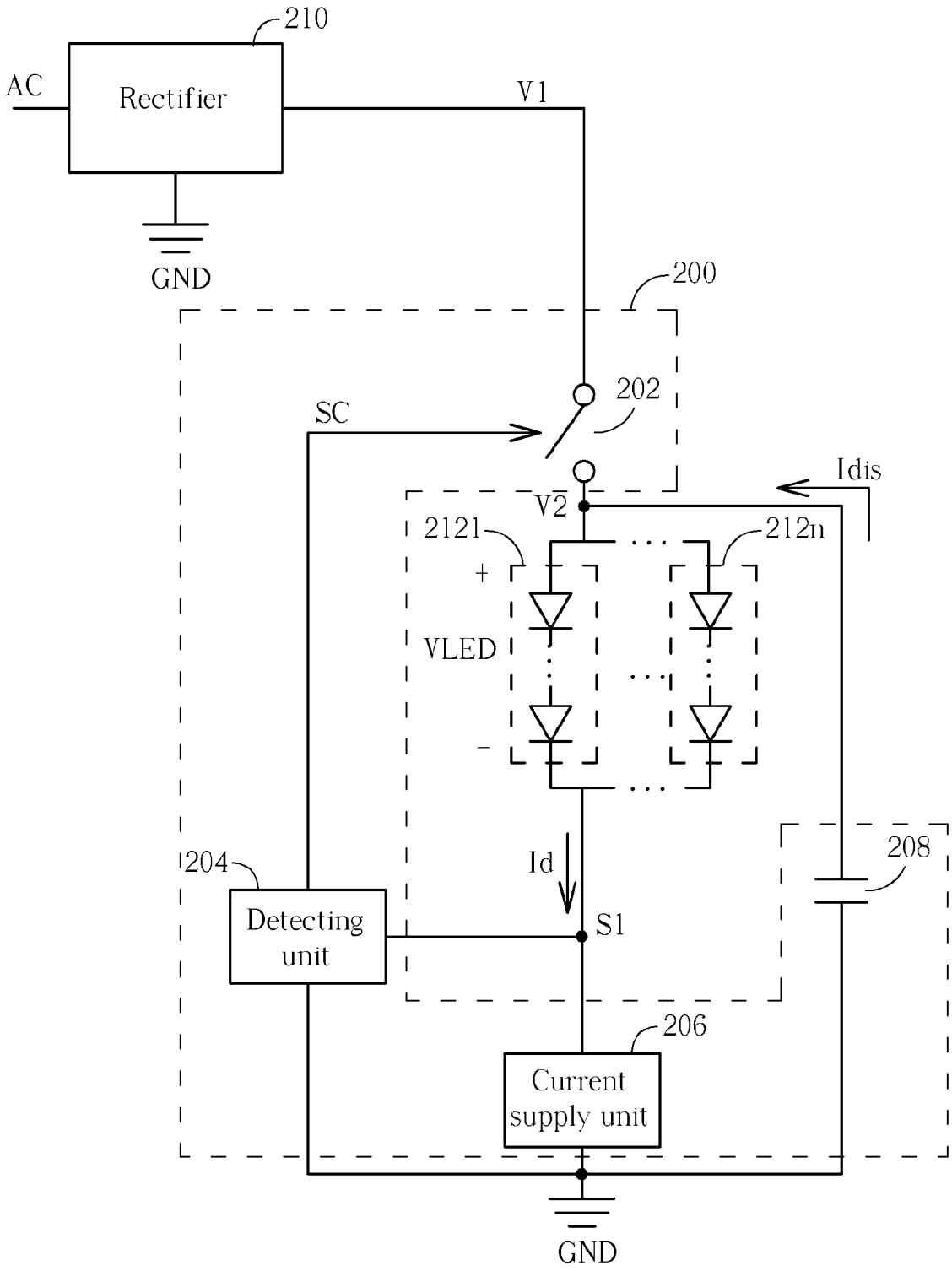
FIG. 3B is a diagram illustrating corresponding operation of the driving circuit when the switch is turned off.
Figure 3C:
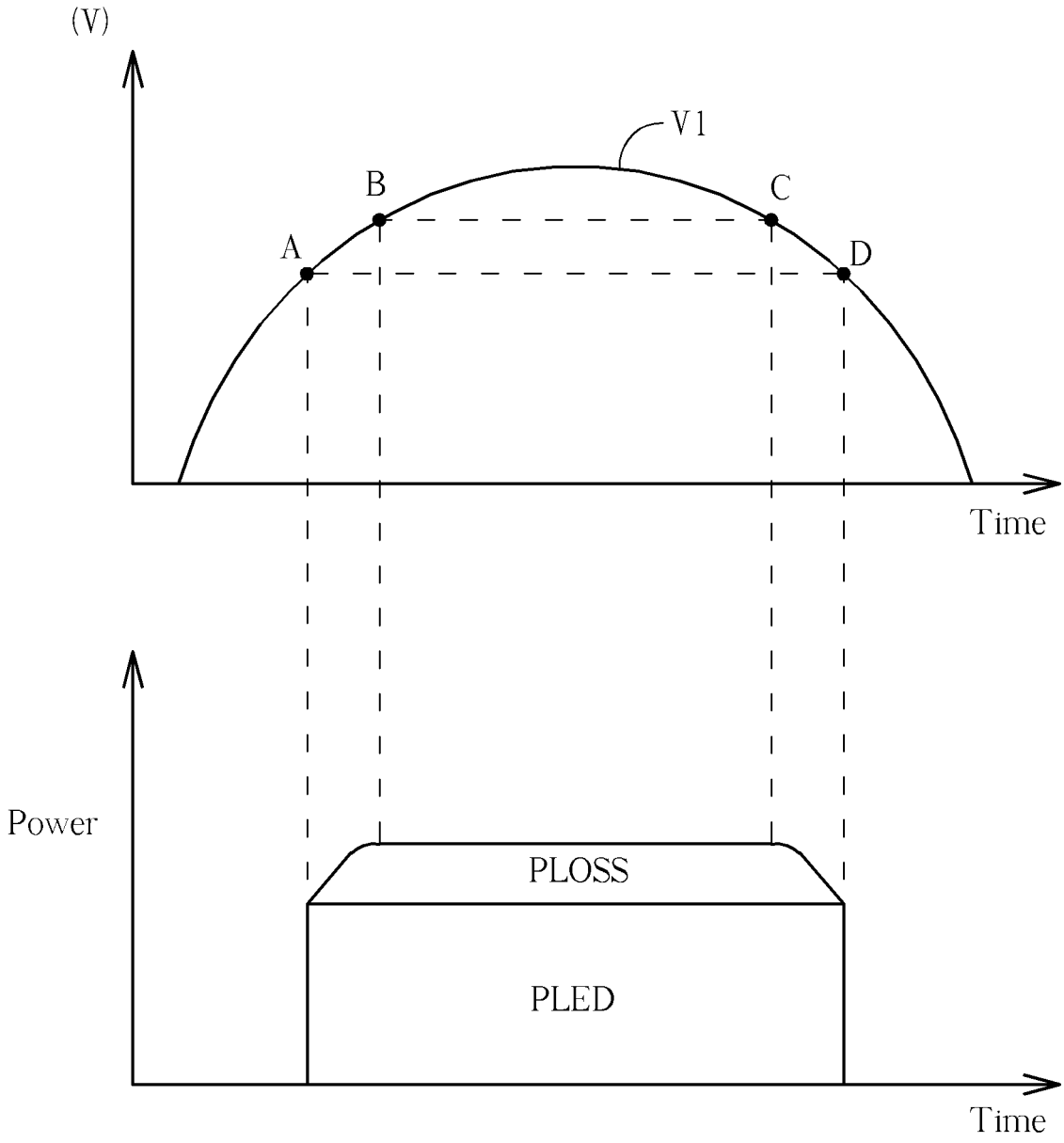
FIG. 3C is a diagram illustrating relationships among power consumption of the at least one series of light emitting diodes, power consumption of the current supply unit, and the first voltage in FIG. 3A and FIG. 3B.

Please refer to FIG. 3A, FIG. 3B, and FIG. 3C. FIG. 3A is a diagram illustrating corresponding operation of the driving circuit 200 when the switch 202 is turned on, FIG. 3B is a diagram illustrating corresponding operation of the driving circuit 200 when the switch 202 is turned off, and FIG. 3C is a diagram illustrating relationships among power consumption PLED of the at least one series of light emitting diodes 2121-212*n*, power consumption PLOSS of the current supply unit 206, and the first voltage V1 in FIG. 3A and FIG. 3B. As shown in FIG. 3A and FIG. 3C, when a voltage of the first terminal of the detecting unit 204 is smaller than a reference voltage VREF, the detecting unit 204 generates the switch control signal SC until the voltage of the first terminal of the detecting unit 204 is greater than the reference voltage VREF, resulting in the switch 202 being turned on according to the switch control signal SC. After the switch 202 is turned on and the first voltage V1 is smaller than a sum of a voltage drop VLED of the at least one series of light emitting diodes 2121-212*n* and a voltage drop of the switch 202, the energy storage unit 208 is charged according to the charge current Ic. Meanwhile, a current flowing through the switch 202 is equal to the charge current Ic. That is to say, the at least one series of light emitting diodes 2121-212*n* is still turned off. After the switch 202 is turned on, and the second voltage V2 is greater than the voltage drop VLED of the at least one series of light emitting diodes 2121-212*n* (meanwhile, the first voltage V1 is located at point A in FIG. 3C), the second voltage V2 starts to drive the at least one series of light emitting diodes 2121-212*n*, and the energy storage unit 208 is still charged according to the charge current Ic. Meanwhile, a current flowing through the switch 202 is a sum of the driving current Id for driving the at least one series of light emitting diodes 2121-212*n* and the charge current Ic.

As shown in FIG. 3B and FIG. 3C, when the voltage of the first terminal of the detecting unit 204 is greater than the reference voltage VREF (meanwhile, the first voltage V1 is located at point B in FIG. 3C), the detecting unit 204 turns off the switch control signal SC, resulting in the switch 202 being turned off. Therefore, the energy storage unit 208 drives the at least one series of light emitting diodes 2121-212*n* according to a discharge current Idis. That is to say, the discharge current Idis is equal to the driving current Id for driving the at least one series of light emitting diodes 2121-212*n*. Meanwhile, a voltage of the first terminal of the at least one series of light emitting diodes 2121-212*n* is equal to a voltage of the first terminal of the energy storage unit 208.

As shown in FIG. 3C, when a voltage of the first terminal of the detecting unit 204 is smaller than the reference voltage VREF again (meanwhile, the first voltage V1 is located at point C in FIG. 3C), the switch 202 is turned on again according to the switch control signal SC. The energy storage unit 208 is charged again according to the charge current Ic, and the first voltage V1 generates the second voltage V2 through the switch 202 again for driving the at least one series of light emitting diodes 2121-212*n* until the second voltage V2 is smaller than the voltage drop VLED of the at least one series of light emitting diodes 2121-212*n* (meanwhile, the first voltage V1 is located at point D in FIG. 3C).

Therefore, as shown in FIG. 3C, after the second voltage V2 is greater than the voltage drop VLED, the second voltage V2 starts to drive the at least one series of light emitting diodes 2121-212*n*. Meanwhile, the power consumption PLED of the at least one series of light emitting diodes 2121-212*n* is determined according to equation (2). After the voltage of the first terminal of the detecting unit 204 is greater than the reference voltage VREF, the voltage of the first terminal of the at least one series of light emitting diodes 2121-212*n* is equal to the voltage of the first terminal of the energy storage unit 208. Therefore, the power consumption PLOSS of the current supply unit 206 is reduced. Thus, the driving circuit 200 is capable of enhancing the energy conversion efficiency as shown in equation (1).

Figure 4:
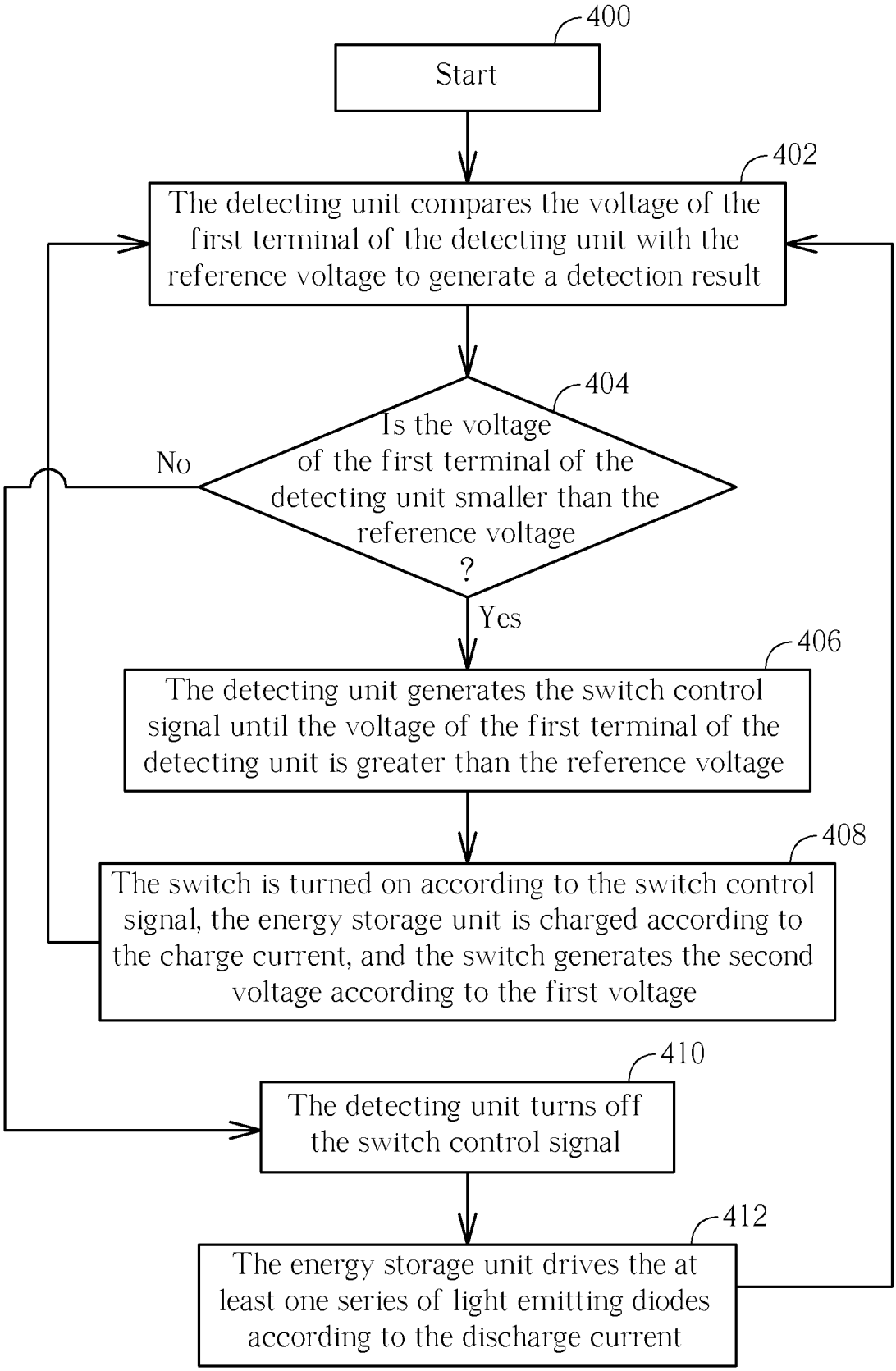
FIG. 4 is a flowchart illustrating a driving method capable of enhancing energy conversion efficiency according to another embodiment.

Please refer to FIG. 4. FIG. 4 is a flowchart illustrating a driving method capable of enhancing energy conversion efficiency according to another embodiment. FIG. 4 uses the driving circuit 200 of FIG. 2 to illustrate the method. Detailed steps are as follows:

Step 400: Start.

Step 402: The detecting unit 204 compares the voltage of the first terminal of the detecting unit 204 with the reference voltage VREF to generate a detection result DR;

Step 404: Is the voltage of the first terminal of the detecting unit 204 smaller than the reference voltage VREF? If yes, go to Step 406; if no, go to Step 410.

Step 406: The detecting unit 204 generates the switch control signal SC until the voltage of the first terminal of the detecting unit 204 is greater than the reference voltage VREF.

Step 408: The switch 202 is turned on according to the switch control signal SC, the energy storage unit 208 is charged according to the charge current Ic, and the switch 202 generates the second voltage V2 according to the first voltage V1; go to Step 402.

Step 410: The detecting unit 204 turns off the switch control signal SC.

Step 412: The energy storage unit 208 drives the at least one series of light emitting diodes 2121-212*n* according to the discharge current Ids; go to Step 402.

In Step 408, the switch 202 is turned on according to the switch control signal SC, the energy storage unit 208 is charged according to the charge current Ic, and the switch 202 generates the second voltage V2 according to the first voltage V1. When the second voltage V2 is greater than the voltage drop VLED, the second voltage V2 drives the at least one series of light emitting diodes 2121-212*n*. Meanwhile, the current flowing through the switch 202 is the sum of the driving current Id for driving the at least one series of light emitting diodes 2121-212*n* and the charge current Ic. In Step 412, when the voltage of the first terminal of the detecting unit 204 is greater than the reference voltage VREF, the detecting unit 204 turns off the switch control signal SC, resulting in the switch 202 being turned off. Therefore, the energy storage unit 208 drives the at least one series of light emitting diodes 2121-212*n* according to the discharge current Idis. Meanwhile, the discharge current Idis is equal to the driving current Id for driving the at least one series of light emitting diodes 2121-212*n*.

To sum up, the driving circuit capable of enhancing energy conversion efficiency and driving method thereof utilize the detecting unit to compare the voltage of the second terminal of the at least one series of light emitting diodes with the reference voltage for determining whether the switch is turned on or turned off. Therefore, the present invention can reduce the power consumption of the current supply unit. That is to say, the power consumption of the current supply unit is not increased with the increase of the first voltage. Thus, compared to the prior art, the present invention can enhance the energy conversion efficiency.

Those skilled in the art will readily observe that numerous modifications and alterations of the device and method may be made while retaining the teachings of the invention.

What is claimed is:

1. A driving circuit capable of enhancing energy conversion efficiency, the driving circuit comprising:

a switch having a first terminal for receiving a first voltage, a second terminal, and a third terminal for being coupled to a first terminal of at least one series of light emitting diodes;

a detecting unit having a first terminal for being coupled to a second terminal of the at least one series of light emitting diodes, a second terminal coupled to the second terminal of the switch for outputting a switch control signal, and a third terminal coupled to ground, wherein the detecting unit is used for generating the switch control signal according to a voltage of the second terminal of the at least one series of light emitting diodes;

a current supply unit having a first terminal for being coupled to the second terminal of the at least one series of light emitting diodes, and a second terminal coupled to the ground, wherein the current supply unit is used for providing a driving current to the at least one series of light emitting diodes; and an energy storage unit having a first terminal for being coupled to the first terminal of the at least one series of light emitting diodes, and a second terminal coupled to the ground, wherein the energy storage unit is used for being charged according to a charge current when the switch is turned on, and transmitting energy stored in the energy storage unit to the at least one series of light emitting diodes when the switch is turned off.

2. The driving circuit of claim 1, wherein the energy storage unit is a capacitor.

3. The driving circuit of claim 1, wherein the switch is a P-type metal-oxide-semiconductor transistor.

4. The driving circuit of claim 1, wherein the switch is an N-type metal-oxide-semiconductor transistor.

5. The driving circuit of claim 1, wherein the switch is a transmission gate.

6. The driving circuit of claim 1, wherein each series of light emitting diodes of the at least one series of light emitting diodes includes at least one light emitting diode, and each series of light emitting diodes has the same number of light emitting diodes.

7. The driving circuit of claim 1, further comprising:

a rectifier for receiving an alternating current voltage, and generating the first voltage according to the alternating current voltage.

8. A driving method capable of enhancing energy conversion efficiency, the driving method comprising:

a detecting unit comparing a voltage of a first terminal of the detecting unit with a reference voltage to generate a detection result; and when the voltage of the first terminal of the detecting unit is greater than the reference voltage, the detecting unit turns off a switch control signal, a switch is turned off accordingly, and an energy storage unit drives at least one series of light emitting diodes through a terminal of the at least one series of light emitting diodes according to a discharge current;

wherein the energy storage unit does not boost a voltage of the terminal of the at least one series of light emitting diodes.

9. The driving method of claim 8, wherein when the voltage of the first terminal of the detecting unit is smaller than the reference voltage, the detecting unit generates the switch control signal until the voltage of the first terminal of the detecting unit is greater than the reference voltage, the switch is turned on according to the switch control signal, and the energy storage unit is charged according to a charge current.

10. The driving method of claim 9, wherein after the switch is turned on, the switch receives a first voltage to generate a second voltage.

* * * * *